US008647491B2

(12) United States Patent
Hartmann et al.

(10) Patent No.: US 8,647,491 B2
(45) Date of Patent: Feb. 11, 2014

(54) PYROPHOSPHATE-BASED BATH FOR PLATING OF TIN ALLOY LAYERS

(75) Inventors: Philip Hartmann, Berlin (DE); Lars Kohlmann, Berlin (DE); Heiko Brunner, Berlin (DE); Klaus-Dieter Schulz, Falkensee (DE)

(73) Assignee: Atotech Deutschland GmbH, Berlin (DE)

( * ) Notice: Subject to any disclaimer, the term of this patent is extended or adjusted under 35 U.S.C. 154(b) by 370 days.

(21) Appl. No.: 12/864,180

(22) PCT Filed: Feb. 5, 2009

(86) PCT No.: PCT/EP2009/000802

§ 371 (c)(1),
(2), (4) Date: Jul. 22, 2010

(87) PCT Pub. No.: WO2009/109271

PCT Pub. Date: Sep. 11, 2009

(65) Prior Publication Data

US 2010/0300890 A1 Dec. 2, 2010

(30) Foreign Application Priority Data

Feb. 29, 2008 (EP) ..... 08003786

(51) Int. Cl.
*C25D 3/60* (2006.01)
*C25D 3/58* (2006.01)

(52) U.S. Cl.
USPC ..... 205/253; 205/241

(58) Field of Classification Search
USPC ..... 205/253, 241
See application file for complete search history.

(56) References Cited

U.S. PATENT DOCUMENTS

| | | | | |
|---|---|---|---|---|
| 4,652,347 | A * | 3/1987 | Kobayashi | 205/213 |
| 4,973,389 | A * | 11/1990 | Majentny et al. | 205/162 |
| 5,902,472 | A * | 5/1999 | Arai et al. | 205/125 |
| 6,210,556 | B1 * | 4/2001 | Toben et al. | 205/253 |
| 6,383,352 | B1 * | 5/2002 | Shyu et al. | 204/292 |
| 6,416,571 | B1 | 7/2002 | Kaneko et al. | |
| 6,607,653 | B1 * | 8/2003 | Tsuji et al. | 205/241 |
| 6,875,253 | B2 * | 4/2005 | Daimon et al. | 75/255 |
| 2004/0045832 | A1 * | 3/2004 | Martyak | 205/131 |
| 2005/0166790 | A1 | 8/2005 | Urata et al. | |
| 2005/0199506 | A1 * | 9/2005 | Toben et al. | 205/253 |
| 2007/0217965 | A1 * | 9/2007 | Johnson et al. | 422/139 |

FOREIGN PATENT DOCUMENTS

| | | | | |
|---|---|---|---|---|
| DE | 3320563 | A1 * | 12/1984 | C23C 3/00 |
| JP | 05163599 | A * | 6/1993 | C25D 17/08 |
| JP | 10-102278 | A | 4/1998 | |
| WO | 2004/005528 | A2 | 1/2004 | |
| WO | WO 2004005528 | A2 * | 1/2004 | |

OTHER PUBLICATIONS

Kuznetsov et al., "Electrodeposition of Copper-Containing Polymer Coatings from Sulfate Electrolytes Containing N-Methylpyrrolidone", Protection of Metals (no month, 2005), vol. 41, No. 5, pp. 427-430.*

G.P. Barchan et al., "Electrolyte for nickel based coatings—contains nickel sulphate, boric acid and derivs. of pyrrolidone and improves coating properties" XP-002485326 (1988).

V.A. Smirnov et al., "Chromium plating electroylte compsn.—contg. chromium sulphate, sodium sulphate, methyl pyrrolidone and di alkyl-methyl benzyl ammonium chloride" (XP-002485327)-(1981).

L. Oniciu et al., "Reviews of Applied Electrochemistry 29—Some fundamental aspects of levelling and brightening in metal electrodeposition", Journal of Applied Electrochemistry, vol. 21, pp. 565-574 (1991).

M. Jordan et al., "The Electrodeposition of Tin and its Alloys", Eugen G. Leuze Publishers—1st Edition, Chapter 13, pp. 155-163 (1995).

* cited by examiner

*Primary Examiner* — Edna Wong
(74) *Attorney, Agent, or Firm* — Edwards Wildman Palmer LLP; Peter F. Corless; Christine C. O'Day

(57) ABSTRACT

An aqueous cyanide-free electrolyte bath for plating of tin alloy layers on substrate surfaces comprising (i) a tin ion source and a source for another alloy element, characterized in that it further contains (ii) N-methyl pyrrolidone is described.

21 Claims, No Drawings

PYROPHOSPHATE-BASED BATH FOR PLATING OF TIN ALLOY LAYERS

FIELD OF THE INVENTION

The present invention relates to an aqueous cyanide-free bath and a method for cyanide-free plating of tin alloys, in particular tin-copper alloys, which contains N-methyl pyrrolidone as an organic gloss agent.

The invention enables the cyanide-free plating of homogenous glossy tin alloy layers, in particular tin-copper alloy layers, the alloy ratio of which can be specifically controlled depending on the metal salt ratio used within the electrolyte.

PRIOR ART

Tin alloys, and in particular copper-tin alloys, have become the focus of interest as alternatives to nickel plating. Electrodeposited nickel layers are commonly used for decorative as well as functional applications.

Despite their good characteristics, nickel layers are problematic regarding health-related aspects because of their sensitising properties. Therefore, alternatives are of utmost interest.

Besides tin-lead alloys, which have become established in the electronics sector, but which are environmentally problematic, in recent years predominantly copper-tin alloys have been considered as a substitute. Chapter 13 (pp. 155 to 163) of the publication "*The Electrodeposition of Tin and its Alloys*" by Manfred Jordan (Eugen G. Leuze Publ., 1st Ed., 1995) gives an overview of the known bath types for copper-tin alloy platings.

Cyanide-containing copper-tin alloy baths have been industrially established. Because of increasingly strict regulations and the high toxicity as well as problematic and expensive disposal of these cyanide-containing baths, there is increasing demand for cyanide-free copper-tin electrolytes.

For this purpose, some cyanide-free pyrophosphate-containing electrolytes have been developed. Thus, JP 10-102278 A describes a pyrophosphate-based copper-tin alloy bath, which contains reaction products of an amine and an epihalodrine derivative (mole ratio 1:1) as an additive, an aldehyde derivative and, depending on the use, optionally a surfactant. Also, U.S. Pat. No. 6,416,571 B1 describes a pyrophosphate-based bath, which also contains as an additive a reaction product of an amine and an epihalohydrine derivative (mole ratio 1:1), a cationic surfactant and optionally further surface tension active agents and an antioxidant.

The above mentioned baths are disadvantageous with respect to barrel electroplating, since uniform plating layers cannot be obtained, and thus the products do not show any uniform coloration and gloss.

In order to solve this problem, WO 2004/005528 proposes a pyrophosphate-containing copper-tin alloy plating bath, which contains, as an additive, a reaction product of an amine derivative, especially preferably piperazine, of an epihalohydrine derivative, preferably epichlorohydrine, and a glycidyl ether. For preparation of this reaction product, a mixture composed of epichlorohydrine and a glycidyl ether is slowly added to an aqueous solution of the piperazine under strict temperature control, where the temperature has to be kept between 65 and 80° C. A disadvantage of this additive is that the process is difficult to control, in particular at high temperatures, since such products tend to secondary reactions at excessive reaction and/or storage temperatures and thus to the formation of high molecular and thus partially water-insoluble and ineffective polymers. A way out of this predicament can only be achieved by reacting in a very high dilution (<1 wt.-%). With these poorly concentrated additive solutions, a multiple make-up results in a disadvantageous solution structure of the electrolyte. Thus, a longer use of the electrolyte can lead to unsteady plating.

Moreover, this electrolyte shows shortcomings in frame electrodeposition applications. Namely, the quality of the different plated layers, which often show a haze, depends strongly on the kind of substrate movement during electrolysis. Also, copper-tin coatings obtained in this matter often show pores, which is problematic especially in the case of decorative coatings.

SUMMARY OF THE INVENTION

Thus, the object of the present invention is to develop an electroplating bath for tin alloys, which enables the manufacture of optically attractive tin alloy layers.

In doing so, a homogenous tin alloy metal distribution and an optimal tin-metal ratio are to be adjusted. Moreover, a uniform layer thickness with high gloss and a homogenous distribution of the alloy components in the coating are to be maintained over a broad current density range.

Subject of the invention is an aqueous cyanide-free electrolyte bath for plating of tin alloy layers on substrate surfaces comprising (i) a tin ion source and a source for another alloy element as well as (ii) N-methyl pyrrolidone.

DESCRIPTION OF PREFERRED EMBODIMENTS OF THE INVENTION

Besides the aforementioned components (I) and (ii) the electrolyte bath according to the invention can also contain an acid (iii) and/or a pyrophosphate source (iv).

The component (iii) of the aqueous cyanide-free electrolyte bath according to the invention may be any acid that can be used in known electrolyte baths. Preferably, organic sulfonic acids, orthoposphoric acid, sulfuric acid and boric acid are used.

The cyanide-free electrolyte bath according to the invention preferably contains further additives, selected from antioxidants and/or further organic gloss agents.

Preferred organic gloss agents are morpholine, 2-morpholine ethanesulfonic acid, hexamethylenetetramine, 3-(4-morpholino)-1,2-propanediol, 1,4-diazabicyclo-[2.2.2]-octane, 1-benzyl-3-carbamoyl-pyridinium chloride, 1-(2'-chlorobenzyl)-3-carbamoyl-pyridinium chloride, 1-(2'-fluoro-benzyl)-3-carbamoyl-pyridinium chloride, 1-(2'-methoxy-benzyl)-3-carbamoyl-pyridinium chloride, 1-(2'-carboxybenzyl)-3-carbamoyl-pyridinium chloride, 1-(2'-carbamoylbenzyl)-3-carbamoyl-pyridinium chloride, 1-(3'-chlorobenzyl)-3-carbamoyl-pyridinium chloride, 1-(3'-fluorobenzyl)-3-carbamoyl-pyridinium chloride, 1-(3'-methoxybenzyl)-3-carbamoyl-pyridinium chloride, 1-(3'-carboxybenzyl)-3-carbamoyl-pyridinium chloride, 1-(3'-carbamoylbenzyl)-3-carbamoyl-pyridinium chloride, 1-(4'-chlorobenzyl)-3-carbamoyl-pyridinium chloride, 1-(4'-fluorobenzyl)-3-carbamoyl-pyridinium chloride, 1-(4'-methoxybenzyl)-3-carbamoyl-pyridinium chloride, 1-(4'-carbamoylbenzyl)-3-carbamoyl-pyridinium chloride, (1'-methylnaphthyl)-3-carbamoyl-pyridinium chloride, 1-(1'-methylnaphthyl)-3-carbamoyl-pyridinium bromide, 1,1'-(xylenyl)-3,3'-bis-carbamoyl-bis-pyridinium dibromide, 1,1',1"-(mesitylenyl)-3,3',3"-tris-carbamoyl-tri-pyridinium trichloride as well as the corresponding bromides, fluorides, iodides and pseudo halogenides (e.g. triflates, tosylates) of the aforementioned compounds as well as quaternised N,N-bis-[dialkylamino-alkyl]ureas, with benzylated derivatives being especially suitable.

The additives according to the invention can be used alone or as a mixture of multiple different gloss forming agents of the aforementioned representative compounds in a concentration of 0.0001 to 20 g/l and especially preferable 0.001 to 1 g/l.

The tin ion source and the source for a further alloy element can be pyrophosphates. Namely, the tin ion source and the source for further alloy element are also pyrophosphate sources in the sense of the aforementioned component (iv) of the electrolyte bath according to the invention.

In such a case, the concentration of pyrophosphate of the source for a further alloy element is 0.5 to 50 g/l and preferably 1 to 5 g/l. The bath according to the invention can be e.g. copper pyrophosphate in an amount of 0.5 to 50 g/l, preferably 1 to 5 g/l or zinc pyrophosphate in these amounts.

If tin pyrophosphate is used as the tin ion source in the electrolyte bath according to the invention, the concentration generally amounts to 0.5 to 100 g/l with concentrations of 10 to 40 g/l being especially preferred.

Besides the tin and metal pyrophosphates mentioned above, other water soluble tin and metal salts can also be used, such as tin sulfate, tin methane sulfonate, copper sulfate, copper methane sulfonate, or the respective zinc salts, which can be recomplexed within the electrolyte into the respective pyrophosphates by addition of suitable alkali metal pyrophosphates. In this case, the concentration ratio of pyrophosphate to tin/metal should be 3 to 80, especially preferred 5 to 50.

Pyrophosphate sources according to component (iv) are especially preferable sodium, potassium and ammonium pyrophosphates in concentrations of 50 to 500 g/l, especially preferable 100 to 400 g/l.

The aforementioned antioxidants include hydroxylated aromatic compounds such as e.g. catechol, resorcin, 1,2-benzenediol, hydroquinone, pyrogallol, α- or β-naphthol, phloroglucine and carbohydrate based systems such as ascorbic acid, sorbitol in concentrations of 0.1 to 1 g/l.

As the organic sulfonic acid, mono- as well as polyalkyl sulfonic acids such as methanesulfonic acid, methanedisulfonic acid, ethanesulfonic acid, propanesulfonic acid, 2-propanesulfonic acid, butanesulfonic acid, 2-butanesulfonic acid, pentanesulfonic acid, hexanesulfonic acid, decanesulfonic acid, dodecanesulfonic acid as well as their salts and hydroxylated derivatives can be used. Especially preferred is the use of methanesulfonic acid in a concentration of 0.01 to 1 g/l.

The baths according to the invention has a pH of 3 to 9, especially preferable 6 to 8.

Unexpectedly and surprisingly, it was found that by addition of N-methyl pyrrolidone, a significant improvement of the plated layers can be achieved with respect to gloss and absence of pores, preferably in a concentration of 0.1 to 50 g/l, especially preferable 0.1 to 4 g/l.

The baths according to the invention can be prepared using common methods, e.g. by addition of the specific amounts of the afore described components to water. The amounts of basic, acidic and buffer components such as sodium pyrophosphate, methanesulfonic acid and/or boric acid should be chosen so that the bath reaches a pH range of at least 6 to 8.

The baths according to the invention are plating a refined, even and ductile copper-tin alloy layer at all common temperatures from about 15 to 50° C., preferably 20° C. to 40° C., especially preferable 25° C. to 30° C. At these temperatures, the baths according to the invention are stable and effective over a wide current density range of 0.01 to 2 A/dm$^2$, most preferably 0.25 to 0.75 A/dm$^2$.

The baths according to the invention can be operated in a continuous or intermittent manner, and bath components will have to be replenished from time to time. The bath components can be added singly or in combination. Moreover, they can be varied in a wide range dependent from consumption and actual concentration of the single components.

One advantage of the bath according to the invention in comparison to the electrolyte of WO 2004/005528 is the excellent reproducibility and long-term stability of the formulations according to the invention compared to the reaction products of piperazine with epichlorhydrin and glycidyl ether.

The aqueous baths according to the invention can be used in general for all kind of substrates, on which tin alloys are to be plated. Examples for suitable substrates include copper-zinc alloys, ABS plastic surfaces coated with chemical copper or chemical nickel, soft steel, stainless steel, spring steel, chrome steel, chromium molybdenum steel, copper and tin.

Another object is thus a method for electroplating of copper-tin alloys on common substrates using the bath according to the invention, where the substrate to be coated is introduced into the electrolyte bath.

Preferably, the plating of coating occurs in the process according to the invention at a current density of 0.25 to 0.75 A/dm$^2$ and at a temperature of 15 to 50° C., preferably 25 to 30° C.

The process according to the invention can be carried out in an application for bulk parts, for example, as a barrel electroplating process and for plating on larger workpieces as a frame electroplating process. In doing so, anodes are used, which can be soluble such as copper anodes, tin anodes or suitable copper-tin alloy anodes, which serve simultaneously as copper and/or tin ion source so that the copper deposited on the cathode and/or tin by dissolution of copper and/or tin at the anode is substituted.

On the other hand, insoluble anodes (e.g. platinated titanium mixed oxide anodes) can be used while the copper and tin ions extracted from the electrolyte have to be replaced in another way, e.g. by addition of the respective soluble metal salts. As possible in the electroplating process, the process according to the invention can be carried out under injection of nitrogen or argon, with or without movement of the substrate without resulting in disadvantages for the obtained coatings. For preventing or reducing, respectively, oxidations of the introduced additives or the tin (ii) ions, respectively, the method can be run with separation of electrode spaces or with use of membrane anodes, whereby a significant stabilisation of the electrolyte can be achieved.

Common direct current converters or pulse converters can be used as the carbon source.

EXAMPLES

Working Example 1

An electrolyte is used with the following composition:

300 g/l tetrapotassium pyrophosphate
10 g/l copper pyrophosphate
30 g/l tin pyrophosphate
50 g/l boric acid
32.4 ml/l phosphoric acid 85%
40 ml/l N-methyl pyrrolidone
0.1 g/l 1-(pentafluorobenzyl)-3-carbamoyl-pyridinium-chloride 250 ml of the electrolytes having a pH of 7 are filled into a Hull cell. A titanium mixed oxide electrode is used as the anode. The cathode sheet is coated 10 min at 1 A. After having finished the plating, the sheet is rinsed and dried using compressed air. A high gloss plating is obtained.

Working Example 2

An electrolyte is used with the following composition:
300 g/l tetrapotassium pyrophosphate
10 g/l copper pyrophosphate
30 g/l tin pyrophosphate
50 g/l boric acid
32.4 ml/l phosphoric acid 85%
20 ml/l N-methyl pyrrolidone
0.06 g/l 1-benzyl-3-acetyl-pyridinium-chloride 250 ml of the electrolytes having a pH of 7 are filled into a Hull cell. A titanium mixed oxide electrode is used as the anode. The cathode sheet is coated 10 min at 1 A. After having finished the plating, the sheet is rinsed and dried using compressed air. A high gloss plating with a slight haze in the low current density range was obtained.

Working Example 3

An electrolyte is used with the following composition:
300 g/l tetrapotassium pyrophosphate
10 g/l copper pyrophosphate
30 g/l tin pyrophosphate
50 g/l boric acid
32.4 ml/l phosphoric acid 85%
40 ml/l N-methyl pyrrolidone
0.03 g/l 1-(4-methoxy-benzyl)-3-carbamoyl-pyridinium-chloride 250 ml of the electrolytes having a pH of 7 are filled into a Hull cell. A titanium mixed oxide electrode is used as the anode. The cathode sheet is coated 10 min at 1 A. After having finished the plating, the sheet is rinsed and dried using compressed air. A glossy plating was obtained.

Working Example 4

An electrolyte is used with the following composition:
300 g/l tetrapotassium pyrophosphate
10 g/l copper pyrophosphate
30 g/l tin pyrophosphate
50 g/l boric acid
32.4 ml/l phosphoric acid 85%
40 ml/l N-methyl pyrrolidone
0.03 g/l 1,1'-(xylenyl)-3',3-bis-carbamoyl-bis-pyridinium-dichloride 250 ml of the electrolytes having a pH of 7 are filled into a Hull cell. A titanium mixed oxide electrode is used as the anode. The cathode sheet is coated 10 min at 1 A. After having finished the plating, the sheet is rinsed and dried using compressed air. A high gloss plating was obtained.

Working Example 5

An electrolyte is used with the following composition:
300 g/l tetrapotassium pyrophosphate
10 g/l copper pyrophosphate
30 g/l tin pyrophosphate
50 g/l boric acid
32.4 ml/l phosphoric acid 85%
40 ml/l N-methyl pyrrolidone
0.12 g/l 1-(4'-carboxy-benzyl)-3-carbamoyl-pyridinium-chloride 250 ml of the electrolytes having a pH of 7 are filled into a Hull cell. A titanium mixed oxide electrode is used as the anode. The cathode sheet is coated 10 min at 1 A. After having finished the plating, the sheet is rinsed and dried using compressed air. A high gloss plating was obtained.

Working Example 6

An electrolyte is used with the following composition:
300 g/l tetrapotassium pyrophosphate
10 g/l copper pyrophosphate
30 g/l tin pyrophosphate
50 g/l boric acid
32.4 ml/l phosphoric acid 85%
40 ml/l N-methyl pyrrolidone
3 ml/l 1-(benzyl)-3-carbamoyl-pyridinium-chloride (35% solution)

250 ml of the electrolytes having a pH of 7 are filled into a Hull cell. A titanium mixed oxide electrode is used as the anode. The cathode sheet is coated 10 min at 1 A. After having finished the plating, the sheet is rinsed and dried using compressed air. A high gloss plating was obtained.

Working Example 7

An electrolyte is used with the following composition:
300 g/l tetrapotassium pyrophosphate
10 g/l copper pyrophosphate
30 g/l tin pyrophosphate
50 g/l boric acid
32.4 ml/l phosphoric acid 85%
40 ml/l N-methyl pyrrolidone
3 g/l morpholine 250 ml of the electrolytes having a pH of 7 are filled into a Hull cell. A titanium mixed oxide electrode is used as the anode. The cathode sheet is coated 10 min at 1 A. After having finished the plating, the sheet is rinsed and dried using compressed air. A high gloss plating was obtained.

Working Example 8

An electrolyte is used with the following composition:
300 g/l tetrapotassium pyrophosphate
10 g/l copper pyrophosphate
30 g/l tin pyrophosphate
50 g/l boric acid
32.4 ml/l phosphoric acid 85%
40 ml/l N-methyl pyrrolidone
5 g/l 2-morpholino-ethansulfonic acid 250 ml of the electrolytes having a pH of 7 are filled into a Hull cell. A titanium mixed oxide electrode is used as the anode. The cathode sheet is coated 10 min at 1 A. After having finished the plating, the sheet is rinsed and dried using compressed air. A high gloss plating was obtained.

Working Example 9

An electrolyte is used with the following composition:
300 g/l tetrapotassium pyrophosphate
10 g/l copper pyrophosphate
30 g/l tin pyrophosphate
50 g/l boric acid
32.4 ml/l phosphoric acid 85%
40 ml/l N-methyl pyrrolidone
3 g/l 3-(4-morpholino)-1,2-propandiol 250 ml of the electrolytes having a pH of 7 are filled into a Hull cell. A titanium mixed oxide electrode is used as the anode. The cathode sheet is coated 10 min at 1 A. After having finished the plating, the sheet is rinsed and dried using compressed air. A high gloss plating was obtained.

The invention claimed is:

1. An aqueous cyanide-free electrolyte bath for plating of tin-copper alloy layers on substrate surfaces, comprising:

(i) a tin ion source and a source of copper, (ii) N-methyl pyrrolidone, and (iii) a pyrophosphate source, wherein the bath is prepared by adding the tin ion source, the source of copper and the N-methyl pyrrolidone to water, and pyrophosphate is present at a concentration which is 3 to 80 times greater than that of tin/copper.

2. The aqueous cyanide-free electrolyte bath according to claim 1, further comprising an acid.

3. The aqueous cyanide-free electrolyte bath according to claim 2, wherein the acid is orthophosphoric acid, sulfuric acid or methanesulfonic acid.

4. The aqueous cyanide-free electrolyte bath according to claim 1, wherein the tin ion source is tin pyrophosphate.

5. The aqueous cyanide-free electrolyte bath according to claim 4, containing tin pyrophosphate in an amount of 0.5 to 100 g/l.

6. The aqueous cyanide-free electrolyte bath according to claim 5, containing tin pyrophosphate as the tin ion source in an amount of 10 to 40 g/l and copper pyrophosphate as the source of copper in an amount of 1 to 5 g/l.

7. The aqueous cyanide-free electrolyte bath according to claim 1, wherein the source of copper is copper pyrophosphate.

8. The aqueous cyanide-free electrolyte bath according to claim 1, wherein the pyrophosphate source is selected from the group consisting of sodium, potassium and ammonium pyrophosphates.

9. The aqueous cyanide-free electrolyte bath according to claim 8, containing the pyrophosphate source in a concentration of 50 to 500 g/l.

10. The aqueous cyanide-free electrolyte bath according to claim 1, containing N-methylpyrrolidone in a concentration of 0.1 to 50 g/l.

11. The aqueous cyanide-free electrolyte bath according to claim 10, containing N-methylpyrrolidone in a concentration of 0.1 to 4 g/l.

12. The aqueous cyanide-free electrolyte bath according to claim 1 having a pH value of 3 to 9.

13. The aqueous cyanide-free electrolyte bath according to claim 1, further comprising an antioxidant and/or an organic gloss agent.

14. The aqueous cyanide-free electrolyte bath according to claim 13, wherein the organic gloss agent is selected from the group consisting of morpholine, 2-morpholine ethanesulfonic acid, hexamethylenetetramine, 3-(4-morpholino)-1,2-propanediol, 1,4-diazabicyclo-[2.2.2]-octane, 1-benzyl-3-carbamoyl-pyridinium chloride, 1-(2'-chloro-benzyl)-3-carbamoyl-pyridinium chloride, 1-(2'-fluoro-benzyl)-3-carbamoyl-pyridinium chloride, 1-(2'-methoxy-benzyl)-3-carbamoyl-pyridinium chloride, 1-(2'-carboxy-benzyl)-3-carbamoyl-pyridinium chloride, 1-(2'-carbamoyl-benzyl)-3-carbamoyl-pyridinium chloride, 1-(3'-chloro-benzyl)-3-carbamoyl-pyridinium chloride, 1-(3'-fluoro-benzyl)-3-carbamoyl-pyridinium chloride, 1-(3'-methoxy-benzyl)-3-carbamoyl-pyridinium chloride, 1-(3'-carboxy-benzyl)-3-carbamoyl-pyridinium chloride, 1-(3'-carbamoyl-benzyl)-3-carbamoyl-pyridinium chloride, 1-(4'-chloro-benzyl)-3-carbamoyl-pyridinium chloride, 1-(4'-fluoro-benzyl)-3-carbamoyl-pyridinium chloride, 1-(4'-methoxy-benzyl)-3-carbamoyl-pyridinium chloride, 1-(4'-carbamoyl-benzyl)-3-carbamoyl-pyridinium chloride, (1'-methyl-naphthyl)-3-carbamoyl-pyridinium chloride, 1-(1-methyl-naphthyl)-3-carbamoyl-pyridinium bromide, 1,1'-(xylenyl)-3,3'-bis-carbamoyl-bis-pyridinium dibromide, 1,1',1"-(mesitylenyl)-3,3',3"-tris-carbamoyl-tri-pyridinium trichloride as well as the corresponding bromides, fluorides, iodides and pseudo halogenides of the aforementioned compounds and quaternised N,N-bis-[dialkylamino-alkyl]ureas.

15. A process for electroplating of a glossy and even tin-copper alloy coating, comprising introducing a substrate to be coated into the aqueous cyanide-free electrolyte bath according to claim 1 and electroplating the tin-copper alloy coating on the substrate.

16. The process according to claim 15, wherein the bath is operated at a current density of 0.01 to 2 $A/dm^2$.

17. The process according to claim 16, wherein the bath is operated at a current density of 0.25 to 0.75 $A/dm^2$.

18. The process according to claim 15, wherein the bath is operated at a temperature of 15 to 50° C.

19. The process according to claim 18, wherein the bath is operated at a temperature of 25 to 30° C.

20. The process according to claim 15, wherein the coating on the substrate is electroplated using a frame electroplating method.

21. The process according to claim 15, wherein membrane anodes are used as anodes.

* * * * *